US007438000B2

(12) United States Patent
Schneider et al.

(10) Patent No.: US 7,438,000 B2
(45) Date of Patent: Oct. 21, 2008

(54) RUNNING GEAR FOR RAIL VEHICLES

(75) Inventors: Richard Schneider, Loehningen (CH); Wolfgang Auer, Kassel (DE); Uwe Reimann, Siegen (DE); Siegmund Möhner, Kreuztal (DE)

(73) Assignee: Bombardier Transportation GmbH, Berlin (DE)

( * ) Notice: Subject to any disclaimer, the term of this patent is extended or adjusted under 35 U.S.C. 154(b) by 181 days.

(21) Appl. No.: 10/526,769

(22) PCT Filed: Sep. 5, 2003

(86) PCT No.: PCT/EP03/09888

§ 371 (c)(1),
(2), (4) Date: Dec. 1, 2005

(87) PCT Pub. No.: WO2004/022405

PCT Pub. Date: Mar. 18, 2004

(65) Prior Publication Data

US 2006/0117986 A1 Jun. 8, 2006

(30) Foreign Application Priority Data

Sep. 5, 2002 (DE) ..... 102 40 968

(51) Int. Cl.
*B61F 5/00* (2006.01)

(52) U.S. Cl. ..... 105/199.2; 105/199.1

(58) Field of Classification Search ..... 105/199.1, 105/199.2, 199.3, 199.4, 199.05, 198, 198.1, 105/198.7, 182.1, 187, 190.1, 190.2, 197.05, 105/453, 165, 167, 168
See application file for complete search history.

(56) References Cited

U.S. PATENT DOCUMENTS 3,628,465 A 12/1971 Dobson et al.
3,717,104 A 2/1973 Law et al.
3,845,724 A 11/1974 Boocock et al.

(Continued)

FOREIGN PATENT DOCUMENTS

DE 2145738 A 3/1973

(Continued)

*Primary Examiner*—Mark T Le
(74) *Attorney, Agent, or Firm*—David P. Owen; Jacobus C. Rasser; Howrey LLP

(57) ABSTRACT

The invention relates to a running gear for rail vehicles, especially for passenger traffic, wherein a frame (1) is supported, by means of primary springs, on wheels or sets of wheels, and whereon a superstructure (5) is supported, optionally with insertion of a bolster (4). The bolster (4) or the superstructure (5) is supported by means of secondary springs, in relation to the frame (1), on at least one spring carrier (2), the bolster (4) or the superstructure (5) is connected to the frame (1) by means of a shock absorber used to damp vertical and/or rolling movements, and the spring carrier (2) is suspended on the frame by means of pendulums (3). The fixing points of the pendulums (3) on the running gear frame (1) are inwardly staggered, unlike vertically arranged pendulums, in such a way that the longitudinal axes of the pendulums (3) extend diagonally. At least one active control element (7) is at least partially arranged in the horizontal direction between the frame (1) and the spring carrier (2) or between the fame (1) and the bolster (4), in such a way that it supports the effect of the centrifugal force and adjusts the incline to an optimum value.

14 Claims, 1 Drawing Sheet

U.S. PATENT DOCUMENTS 5,222,440 A * 6/1993 Schneider ..... 105/199.1
5,970,883 A * 10/1999 Nast ..... 105/164
6,273,002 B1 * 8/2001 Hachmann et al. ..... 105/199.1

FOREIGN PATENT DOCUMENTS

EP 287821 A2 10/1988
EP 621165 A1 10/1994
FR 2092207 A 1/1972

* cited by examiner

RUNNING GEAR FOR RAIL VEHICLES

BACKGROUND OF THE INVENTION

1. Field of the Invention

The present invention relates to a running gear for rail vehicles. The invention is suitable for, but not restricted to, use in rail vehicles for passenger traffic.

2. Description of the Related Art

EP 0 621 165 B1 describes a running gear for rail vehicles in which a running gear frame is carried via primary springs by the wheels or wheel sets and on which, via secondary springs, the car body of the rail vehicle is supported car via a rocker or directly. The rocker or the car body are connected with respect to the running gear frame by means of shock absorbers damping vertical and rolling movements and by means of at least one rolling support absorbing rolling movements. The latter bears fixed levers which are connected to the rocker or to the car body via pendulum elements mounted in an articulated fashion. At least one of the pendulum elements consists of an actuator which can be acted on in the opposite direction when one transverse end of the rocker or the car body dips or rises. A disadvantage here is that, already at relatively low speed in the curve, an unfavourably high transverse acceleration occurs. In order to avoid this, the speed in the curve must be reduced so that the travelling comfort for passengers does not deteriorate, for example.

A number of other known applications for intellectual property rights may resemble the solution according to the invention in some details but have significant disadvantages with respect to the latter. Examples of this are as follows:

According to DE 1 145 738 the inclination technology is arranged above the secondary spring so that, when travelling through curves, the complete transverse acceleration must be intercepted in the secondary suspension In addition, the inclination movement is not supported by the centrifugal force which acts during travelling through curves;

According to EP 0 287 821, the pendulums are arranged parallel to the secondary spring suspension which results in vertical decoupling of spring movement and inclination. Thus, the air springs, which are arranged laterally as usual, must execute the complete inclination movement which requires a suitable volume and space requirement of the air springs associated therewith as well as a pressure compensating device;

According to U.S. Pat. No. 3,717,104, vertical pendulums are provided which represent a fundamentally unstable arrangement which requires additional spring elements or active control elements. In addition, during travelling through curves, the inclination movement is not supported by the centrifugal force but, on the contrary, the actuators must work against the centrifugal force and in addition the centering springs. Furthermore, the rolling pole located under the vehicle floor results in large transverse movements at the level of the rows of seats which is generally perceived as unpleasant by passengers, as well as the need for a severely restricted clearance profile of the car body.

BRIEF SUMMARY OF THE INVENTION

It is the object of the invention to eliminate the disadvantages of the prior art which have been described and, in particular, to propose a running gear for rail vehicles which allows higher speeds in curves. It is further the object of the invention to enhance comfort and to allow able adaptability of existing running gears.

This object is solved by a running gear for rail vehicles, wherein a running gear frame is supported via primary springs on wheels or wheel sets, and whereon a car body is supported via a cradle, the cradle is supported, in relation to the running gear frame, via secondary springs on at least one spring carrier, the cradle or the car body is connected to the running gear frame by means of shock absorbers damping vertical or rolling movements, the spring carrier is supported on the running gear frame by means of hangers, fixing points of the hangers on the running gear frame, contrary to vertically arranged hangers, are inwardly displaced in such a way that longitudinal axes of the hangers extend obliquely, and at least one active control element is at least partially, arranged in the horizontal direction between the running gear frame and the spring carrier or between the running gear frame and the cradle or car body, in such a way that the at least one active control element supports the effect of centrifugal force on the car body and adjusts an inclination thereof to an optimum value.

One advantage of the solution according to the invention is that, by inclining the car body, the passenger does not experience any greater transverse acceleration despite higher speed. This results in enhanced comfort. In the solution according to the invention, the centrifugal force brings about the inclination of the car body. Thus, only small adjusting forces are required to adjust the inclination to the optimum extent. A further advantage is that existing running gears can be adapted at little expense.

In the running gear according to the invention, it is provided that the fixing points of the pendulums on the running gear frame, unlike with vertically arranged pendulums, are inwardly staggered in such a way that the longitudinal axes of the pendulums extend obliquely inwards from bottom to top when the car body is not inclined. Furthermore, at least one active control element is arranged between the running gear frame and the spring carrier or between the running gear frame and the rocker. In this case, it is aligned at least partly, but preferably predominantly, in the horizontal direction, wherein it supports the action of the centrifugal force and adjusts the inclination to an optimum extent The pendulums are preferably arranged in such a way that the longitudinal axes of the pendulums intersect at least approximately at the height of the center of gravity of the car or above the center of gravity of the car when the car body is not inclined. A particularly favorable inclination characteristic is obtained as a result.

Furthermore, at least one passive and/or active damping member is preferably arranged transverse to the direction of travel. Further preferably, at least one damping member is arranged between the running gear frame and the rocker, said damping member preferably being a laterally acting damper which can be adjusted dynamically depending on the transverse speed of the car body.

In an especially advantageous variant of the running gear according to the invention, which has a simple structure and works reliably, at least one pendulum, each, is arranged on both sides of the longitudinal axis of the rail vehicle. At the same time, the pendulums are preferably arranged symmetrically to the longitudinal axis of the rail vehicle.

In further preferred variants of the running gear according to the invention, the at least one active control element is an electrical, hydraulic and/or pneumatic control drive.

BRIEF DESCRIPTION OF THE DRAWINGS

Further preferred embodiments of the invention are obtained from the dependent clams or the following description of a preferred embodiment, respectively, which refers to the appended drawings. It is shown in (not to scale)

DESCRIPTION OF ILLUSTRATIVE EMBODIMENTS

Figure 1:
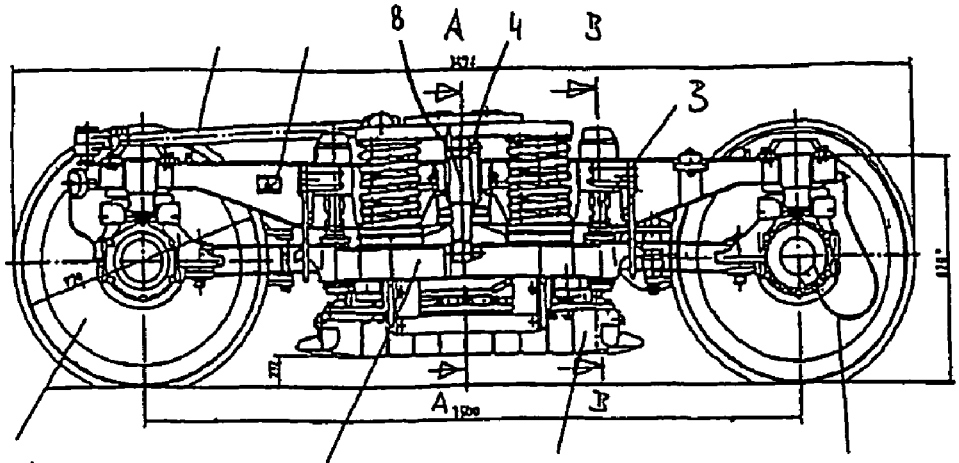
FIG. 1 a schematic diagram of a preferred embodiment of the running gear according to the invention in side view, FIG. 2 a schematic section A-A through the running gear according to FIG. 1.
Figure 2:
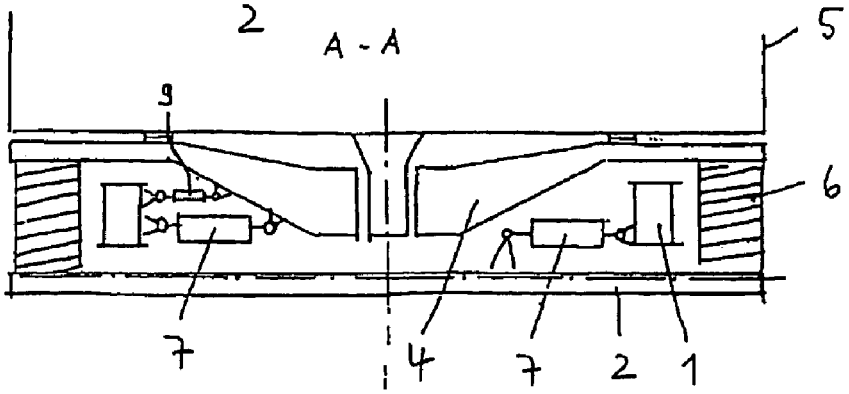
Figure 3:
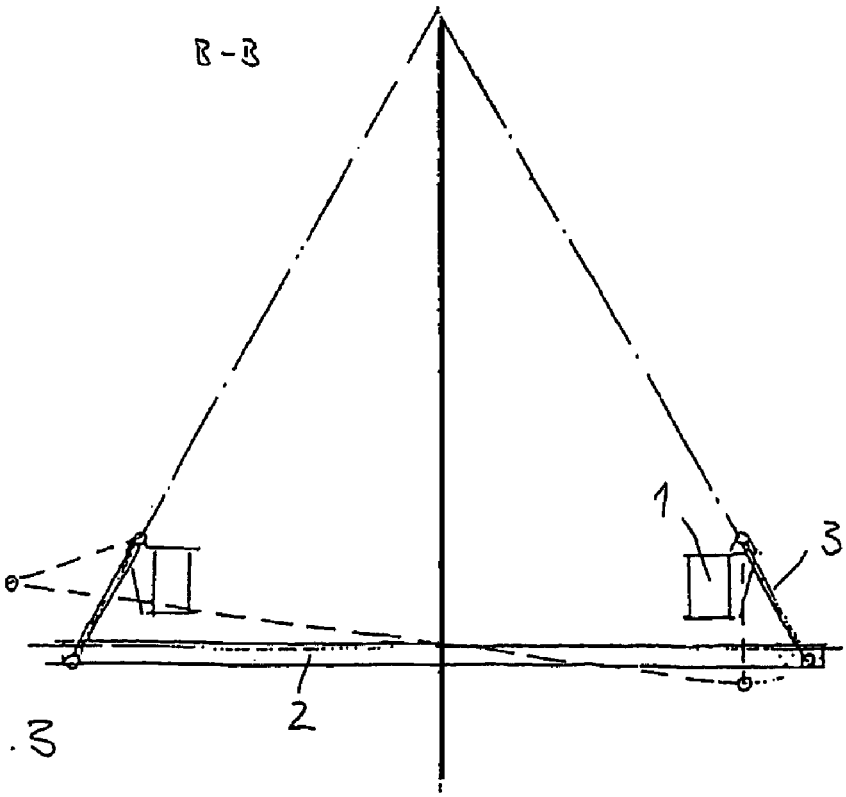
FIG. 3 a schematic section B-B through the running gear according to FIG. 1.

The FIGS. 1 to 3 show a running gear of a rail vehicle in different views. The running gear comprises a frame 1 which is supported via primary springs on wheels set. A spring carrier 2 is affixed on the running gear frame 1 by means of pendulums 3. The spring carrier 2 supports a rocker 4 with a car body 5 positioned thereon by means of secondary helical springs 6. The rocker 4 or the car body 5 is connected to the running gear frame 1 by means of shock absorbers damping vertical or rolling movements.

In a rail curve, the centrifugal force brings about a transverse displacement of the car body 5, the rocker 4 and, via the transverse rigidity of the secondary helical springs 6, also of the spring carrier 2.

An increase in the speed of travel in a curve results in an increase in the transverse acceleration acting on a passenger. However, this should not exceed a limit of, for example, 1.2 m/s2. So that this limit is not exceeded despite increasing the speed of travel, the car body must be inclined in such a way that the transverse acceleration is reduced below the limit.

For this purpose, the upper fixing point of the suspended pendulums 3 on the running gear frame 1 is inwardly staggered in contrast to vertically arranged pendulums. This results in an oblique position of the pendulums 3. Hereby, the system of the spring carrier 2, including the components rocker 4 and car body 5 positioned thereon, can be inclined. As a result of being suspended on oblique pendulums 3, the spring carrier 2 and, at the same time, the rocker 4 and the car body 5 are rotated about their longitudinal axes. Thus, a passenger is not exposed to any greater transverse acceleration despite higher curve speed.

One or more active control elements 7 support the action of the centrifugal force and adjust the inclination to an optimum extent These active control elements 7 are inserted in a predominantly horizontal direction either between the running gear fame 1 and the spring carrier 2 or between the running gear frame 1 and the rocker 4. In this embodiment the optimum inclination of the car body 5, which mainly results from the transverse acceleration of the car body 5, is adjusted by two active control elements 7 laterally acting between the running gear frame 1 and the spring carrier 2, which bring about the corresponding additional or reduced inclination of the car body 5 with respect to the inclination resulting from the transverse acceleration.

In addition to the active control elements 7, passive or active damping members can be incorporated to improve comfort. For example, in addition to enhancing comfort, the dynamic components of the car body transverse movement can be damped by inserting a laterally acting damper, arranged between the running gear frame 1 and the rocker 4, which can be adjusted dynamically depending on the transverse velocity of the car body or the transverse acceleration of the car body.

The invention claimed is:

1. Running gear for rail vehicles, wherein:

a running gear frame is supported via primary springs on wheels or wheel sets, and whereon a car body is supported via a cradle, the cradle is supported, in relation to the running gear frame, via secondary springs on at least one spring carrier, the cradle or the car body is connected to the running gear frame by means of shock absorbers damping vertical or rolling movements, the spring carrier is supported on the running gear frame by means of hangers, fixing points of the hangers on the running gear frame, contrary to vertically arranged hangers, are inwardly displaced in such a way that longitudinal axes of the hangers extend obliquely, and at least one active control element is at least partially, arranged in the horizontal direction between the running gear frame and the spring carrier or between the running gear frame and the cradle or car body, in such a way that the at least one active control element supports the effect of centrifugal force on the car body and adjusts an inclination thereof to an optimum value.

2. The running gear according to claim 1, wherein the hangers are arranged in such a way that the longitudinal axes of the hangers intersect at least approximately at the height of the center of gravity of the car or above the center of gravity of the car.

3. The running gear according to claim 1, further comprising at least one passive or active arranged transverse to the direction of travel.

4. The running gear according to claim 1, further comprising at least one laterally acting damper which can be adjusted dynamically depending on the transverse speed of the car body, arranged between the running gear frame and the cradle or car body.

5. The running gear according to claim 1, wherein the hangers are arranged in symmetrical pairs on either side of the longitudinal axis of the rail vehicle.

6. The running gear according to claim 1, wherein the at least one active control element is an electrical, hydraulic or pneumatic control drive.

7. Running gear for a rail vehicle, comprising:

a running gear frame;

a spring carrier suspended by hangers from the running gear frame, fixing points of the hangers on the frame being inwardly located with respect to fixing points of the hangers on the spring carrier such that the spring carrier can be inclined with respect to the frame;

a cradle supported via secondary springs on the spring carrier;

a car body supported by the cradle and connected to the running gear frame by means of shock absorbers damping vertical or rolling movements; and at least one first active control element arranged substantially in the horizontal direction between the frame and the spring carrier to support the effect of centrifugal force on the car body and adjust an inclination of the spring carrier to an optimum value.

8. The running gear according to claim 7, wherein the hangers are arranged such that their longitudinal axes intersect at a position adjacent to the center of gravity of the car body.

9. The running gear according to claim 7, further comprising at least one passive damper arranged to damp movement of the car body transverse to the direction of travel.

10. The running gear according to claim 7, further comprising at least one active damper arranged to damp movement of the car body transverse to the direction of travel.

11. The running gear according to claim 7, further comprising a laterally acting damper which can be adjusted dynamically depending on the transverse speed of the car body, arranged between the running gear frame and the car body.

12. The running gear according to claim 7, wherein the hangers are arranged in symmetrical pairs on either side of the longitudinal axis of the rail vehicle.

13. The running gear according to claim 7, wherein the active control element is an electrical, hydraulic or pneumatic control drive.

14. The running gear according to claim 7, wherein further a laterally acting damper which can be adjusted dynamically depending on the transverse speed of the car body, is arranged between the running gear frame and the cradle.

* * * * *